US011332969B2

(12) United States Patent
Schmengler et al.

(10) Patent No.: US 11,332,969 B2
(45) Date of Patent: May 17, 2022

(54) MOTORIZED DRIVE SYSTEM, USE OF THE DRIVE SYSTEM FOR ACTUATING A DOOR, AND METHOD FOR PRODUCING A DRIVE SYSTEM

(71) Applicant: STABILUS GMBH, Koblenz (DE)

(72) Inventors: Marcel Schmengler, Bad Neuenahr (DE); Magnus Hümmerich, Koblenz (DE); Sergei Mazepa, Kaisersesch (DE); Florian Höfer, Engers (DE); Marian Bochen, Eitelborn (DE)

(73) Assignee: STABILUS GMBH, Koblenz (DE)

( * ) Notice: Subject to any disclaimer, the term of this patent is extended or adjusted under 35 U.S.C. 154(b) by 0 days.

(21) Appl. No.: 16/959,682

(22) PCT Filed: Jan. 11, 2019

(86) PCT No.: PCT/EP2019/050681
§ 371 (c)(1),
(2) Date: Jul. 2, 2020

(87) PCT Pub. No.: WO2019/138068
PCT Pub. Date: Jul. 18, 2019

(65) Prior Publication Data

US 2020/0370357 A1 Nov. 26, 2020

(30) Foreign Application Priority Data

Jan. 11, 2018 (DE) ..... 10 2018 100 562.8

(51) Int. Cl.
*E05F 11/38* (2006.01)
*E05F 15/614* (2015.01)
*E05F 5/02* (2006.01)

(52) U.S. Cl.
CPC ..... *E05F 15/614* (2015.01); *E05F 5/025* (2013.01); *E05Y 2201/21* (2013.01);
(Continued)

(58) Field of Classification Search
CPC ..... E05F 5/025; E05F 15/622; E05F 15/614; E05Y 2201/246; E05Y 2201/21;
(Continued)

(56) References Cited

U.S. PATENT DOCUMENTS 7,226,111 B2 * 6/2007 Berklich, Jr. ..... B60J 5/101 296/146.4
10,655,378 B2 * 5/2020 Podkopayev ..... F16D 3/46
(Continued)

FOREIGN PATENT DOCUMENTS

DE 102015110089 A1 12/2015
DE 102014212863 A1 1/2016
(Continued)

OTHER PUBLICATIONS

International Search Report for PCT/EP2019/050681 dated Apr. 29, 2019.

*Primary Examiner* — Chi Q Nguyen
(74) *Attorney, Agent, or Firm* — Schmeiser, Olsen & Watts, LLP

(57) ABSTRACT

Provided is a motorized drive system for actuating a door, including at least one gear having a spindle axis and a drive axis, wherein the gear assembly is designed to convert a rotational movement about the drive axis into a rotational movement about the spindle axis; at least one spindle assembly having a threaded spindle which can be rotated about a spindle axis, wherein the threaded spindle is mechanically coupled to a part of the gear assembly that can be rotated about the spindle axis, and at least one drive assembly for driving the threaded spindle with a drive shaft, wherein the drive shaft is mechanically coupled to a part of the gear assembly that can be rotated about the drive axis.

9 Claims, 8 Drawing Sheets

(52) U.S. Cl.
CPC ... *E05Y 2201/216* (2013.01); *E05Y 2201/246* (2013.01); *E05Y 2201/41* (2013.01); *E05Y 2201/422* (2013.01); *E05Y 2201/46* (2013.01); *E05Y 2201/702* (2013.01); *E05Y 2201/704* (2013.01); *E05Y 2201/706* (2013.01); *E05Y 2600/526* (2013.01); *E05Y 2900/531* (2013.01)

(58) Field of Classification Search
CPC ..... E05Y 2201/702; E05Y 2201/216; E05Y 2201/706; E05Y 2201/46; E05Y 2201/41; E05Y 2201/422; E05Y 2201/704; E05Y 2600/526; E05Y 2900/531
USPC ..... 49/340, 341, 342, 324
See application file for complete search history.

(56) References Cited

U.S. PATENT DOCUMENTS

| | | | | |
|---|---|---|---|---|
| 11,111,713 | B2 * | 9/2021 | Noguchi | E05F 15/619 |
| 2007/0151158 | A1 * | 7/2007 | Fenelon | E05F 11/423 49/349 |
| 2011/0266080 | A1 * | 11/2011 | Schmitt | E05C 17/006 180/89.1 |
| 2012/0000304 | A1 | 1/2012 | Hamminga | |
| 2017/0356565 | A1 * | 12/2017 | Kwasniewski | F16K 31/043 |
| 2018/0051502 | A1 * | 2/2018 | Roos | E05B 81/00 |
| 2018/0179788 | A1 * | 6/2018 | Oxley | E05C 17/203 |
| 2019/0112859 | A1 * | 4/2019 | Gumbo | F16H 1/28 |
| 2019/0145137 | A1 * | 5/2019 | Ueno | E05F 5/06 16/82 |
| 2020/0165856 | A1 * | 5/2020 | Scheuring | E05F 5/025 |
| 2020/0386037 | A1 * | 12/2020 | Battlogg | E05F 15/40 |

FOREIGN PATENT DOCUMENTS

| | | | |
|---|---|---|---|
| EP | 1 664 470 | B1 | 7/2008 |
| EP | 1940012 | A1 | 7/2008 |
| EP | 2192675 | A1 | 6/2010 |
| EP | 2543808 | A1 | 1/2013 |
| EP | 3032020 | A1 | 6/2016 |
| WO | 2008077912 | A1 | 7/2008 |

* cited by examiner

MOTORIZED DRIVE SYSTEM, USE OF THE DRIVE SYSTEM FOR ACTUATING A DOOR, AND METHOD FOR PRODUCING A DRIVE SYSTEM

CROSS-REFERENCE TO RELATED APPLICATIONS

This application claims priority to PCT Application No. PCT/EP2019/050681, having a filing date of Jan. 11, 2019, based on German Application No. 10 2018 100 562.8, having a filing date of Jan. 11, 2018, the entire contents both of which are hereby incorporated by reference.

FIELD OF TECHNOLOGY

The following relates to a use of the drive system for actuating a door, in particular a vehicle door, and a production method for a drive system.

Drive systems for, in particular, electromechanical control of, for example, doors, in particular vehicle doors and vehicle flaps, are known from the conventional art. A force of an electric motor is transmitted to the vehicle door, for example via a threaded spindle. Furthermore, the drive systems can include, for example, a clutch for protecting the vehicle door, in particular a connecting element of the drive system to the vehicle door, against overload, a brake for holding the vehicle door in a specific position, a transmission for adapting the transmitted force and speed and/or bearings for absorbing forces that are input into the drive system from the vehicle door.

A generic drive system is described for example in the document EP 1 940 012 A1, the design of which, according to its teaching, in particular paragraphs [0002] to [0006], is included here by reference. For a compact structure and low noise development of the drive system, EP 1 940 012 A1 proposes in the aforementioned paragraphs to use a hysteresis brake for a generic drive system.

Another generic drive system is described in document EP 1 664 470 B1, the teaching of which, in particular paragraphs [0002] to [0009], is included here by reference. EP 1 664 470 B1 discloses in the cited paragraphs a generic drive system and a reduced overall volume due to exact mounting and axial guidance and alignment of the components of the drive system.

The problem with generic drive systems is that sometimes very high forces, for example from a door operated by the drive system, are introduced into the drive system during operation, for example because a force, for example by a user, has a much larger lever with respect to an axis of rotation of the door than the drive system. These forces can damage sensitive components of the drive system, for example a motor or a brake. At the same time, the assemblies cannot be designed to be very voluminous and/or stable, particularly due to cost and installation space restrictions, so that the drive systems can fail prematurely.

SUMMARY

An aspect relates to a drive system, in particular for actuating a door, for example a vehicle door, and a production method for a drive system which is particularly reliable, space-saving and at the same time inexpensive.

A motorized drive system according to embodiments of the invention, in particular for actuating a door, for example a vehicle door, comprises at least one gear assembly with a spindle axis and a drive axis. The gear assembly is designed to translate a rotational movement about the drive axis into a rotational movement about the spindle axis. The drive system can comprise at least one spindle assembly, in particular for actuating the door, with a threaded spindle which can be rotated about a spindle axis, the threaded spindle being mechanically coupled to a part of the transmission assembly which is rotatable about the spindle axis. According to embodiments of the invention, other equivalent force transmission groups based on other force transmission devices such as shafts or V-belts or toothed belts are also conceivable. The drive system comprises at least one drive assembly for driving the force transmission device, such as a threaded spindle, with a complementary force transmission device, such as a drive shaft. Complementary force transmission devices, such as a drive shaft, are advantageously mechanically coupled to a part of the transmission assembly that is rotatable about the drive axis. In the following, the embodiments of force transmission devices and complementary force transmission devices according to embodiments of the invention are described by the representative examples of threaded spindles and drive shafts.

The term "door" in the sense of embodiments of the present invention encompasses any device for reversibly closing or at least partially covering, shading or covering at least one section, in particular an access opening, of a technical device or a building. In addition to doors for access by people, the term "door" also includes, for example, doors at loading and/or unloading openings and/or ventilation openings, in particular windows. A "vehicle door" in the sense of embodiments of the invention encompasses, in addition to doors for the access of passengers to the vehicle, for example trunk lids and bonnets or other openable surface sections of the vehicle, such as luggage flaps of a coach. For the purposes of embodiments of the invention, the term "vehicle" encompasses in particular land craft, watercraft and aircraft.

The expression "mechanically coupled" in the sense of embodiments of the present invention encompasses any coupling that is designed to transmit a mechanical force and/or a torque. Such a coupling can be mediated, for example, by a materially and/or physically connected, in particular rigid, connection and/or a magnetic connection for transmitting kinetic energy.

The spindle axis and the drive axis can be arranged such that they are not coaxial with one another. The drive assembly can be arranged to the side of the spindle axis. A non-coaxial arrangement of the spindle axis and drive axis advantageously prevents a force input into the drive system along the spindle axis, for example from a door actuated by the drive system, from being transmitted along the drive axis. A non-coaxial arrangement leads to a mechanical decoupling or at least partial decoupling of the drive assembly from the spindle assembly and thus protects the drive assembly against application of force via the spindle assembly along the spindle axis. As a result, assemblies of the drive system, in particular a drive assembly, arranged on the drive axis are protected from these forces. Furthermore, the modules arranged on the drive axis can be arranged on the side of the spindle axis, in particular next to modules arranged along the spindle axis. As a result, the assemblies arranged on the side are additionally protected against forces introduced along the spindle axis. Because of the lower mechanical load capacity requirements for the material in terms of type, structure, volume and/or shape resulting from the lower mechanical load, the drive system can be particularly compact, particularly with regard to its length along the spindle axis, and at the same time inexpensive. Thanks to its compact design, the drive system is particularly well suited for vehicle doors, since there is often only a small amount of space available in vehicles, for example in automobiles.

The spindle axis and the drive axis can enclose an angle that is from one of 45° to 90°, from 60° to 90°, or 90°. According to embodiments of the invention, the "angle" is the smaller of the two angles that lie between the two axes at their intersection point—if appropriate after a parallel displacement of at least one of the axes. The closer the angle is to 90°, the more efficiently a rotary movement around the drive axis can be translated into a rotary movement around the spindle axis, which means that the drive system can work particularly efficiently and reliably. In particular, at an angle of 90°, inexpensive and easy to obtain standard gear components can be used.

The at least one drive assembly can comprise at least one motor assembly for driving a rotary movement of the threaded spindle about the spindle axis with a motor shaft rotatable about the drive axis. The motor shaft can be driven by an electric motor, for example. The motor shaft can be encompassed by the drive shaft and/or rigidly connected to the drive shaft. In particular, the motor shaft can be part of the drive shaft or identical to the drive shaft.

The at least one gear assembly can comprise a worm gear for translating a rotational movement about the drive axis into a rotational movement about the spindle axis. A worm gear offers the advantages of a particularly quiet operation and a particularly high load capacity, so that even high torques can be reliably transmitted. Low-noise operation is particularly advantageous for use in vehicle doors of high-priced vehicles, since this gives a high customer value.

The worm gear can comprise a worm shaft that is rotatable about the drive axis and mechanically coupled to the drive shaft, and a worm wheel that is rotatable about the spindle axis and mechanically coupled to the threaded spindle. This configuration allows the worm gear with a particularly compact design to translate a rotational movement of the drive shaft about the drive axis into a rotational movement of the threaded spindle about the spindle axis. According to embodiments of the invention, the worm wheel and the worm shaft can also be interchanged.

The worm shaft can be encompassed by the drive shaft and/or rigidly connected to the drive shaft. In particular, the worm shaft can be part of the drive shaft or identical to the drive shaft.

The worm shaft can be rigidly, in particular positively and/or cohesively, and/or coaxially connected to a motor shaft of a motor assembly and/or a brake shaft of a brake assembly. This enables a particularly efficient and reliable torque transmission between the motor shaft and/or brake shaft and the worm shaft. For example, a section of the motor shaft and/or brake shaft can interact positively with a section of the worm shaft with respect to rotation about the drive axis.

The at least one drive assembly can comprise at least one brake assembly for braking a rotational movement of the threaded spindle about the spindle axis with a brake shaft rotatable about the drive axis and guided through a bearing. The brake assembly can prevent a too rapid movement, for example of a door operated by the drive system, which could injure a user and/or damage the door. In particular, the door can be held in a certain position by the brake assembly, in which the door would not remain without a brake assembly, for example due to the force of gravity acting on it. This also prevents injuries to a user and/or damage to the door.

The brake assembly is arranged on a side of the motor assembly facing the transmission assembly, in particular between the transmission assembly and the motor assembly. In contrast to an arrangement of the brake assembly on the side of the motor assembly facing away from the transmission assembly, the advantages result that control components and/or sensors, which could be negatively affected by magnetic fields, heat and/or vibrations generated by the brake assembly and/or transmission assembly, can be safely arranged on the side of the motor assembly facing away from the transmission assembly. The motor assembly can thus shield the control components and/or sensors against the magnetic fields, heat and/or vibrations, so that no separate shielding is necessary and a particularly cost-effective and compact structure of the drive system is achieved. Furthermore, the control components and/or sensors are more easily accessible on the side facing away from the gear module than on the side facing the gear module, for example for connection to other components or for maintenance.

The motor assembly can include an angular position sensor, in particular a Hall sensor, for measuring an angular position of the motor shaft relative to the motor assembly, the angular position sensor being arranged on a side of the motor assembly facing away from the brake assembly. An angular position sensor, in particular a Hall sensor, can be easily disturbed by magnetic fields, so that an arrangement on the side of the motor assembly facing away from the brake assembly is particularly advantageous for reliable measurement. The angular position sensor can advantageously be used to determine an angular position of the threaded spindle and thus a position of a component actuated by the drive system, for example an opening state of a door, simply, precisely and reliably, for example with the aid of a calibration function The brake assembly can comprise, for example, a mechanical friction brake, for example a disc brake and/or a felt brake. A mechanical friction brake offers the advantages of low manufacturing costs and simple assembly. The brake assembly can include an electromagnetic brake, for example a brake with a switchably energized electromagnet. An electromagnetic brake has the advantage that its function can be controlled electrically, for example by switching an electromagnet on and/or off.

The bearing can comprise, for example, a plain bearing and/or roller bearing, in particular a ball bearing. The bearing advantageously prevents movements of the brake shaft radially to its axis of rotation, which could impair the function of the brake assembly and/or the transmission assembly, for example.

The brake shaft can be encompassed by the drive shaft and/or rigidly connected to the drive shaft. In particular, the brake shaft can be part of the drive shaft or identical to the drive shaft.

The brake shaft can be mechanically coupled to a motor shaft of a motor assembly, rigidly and/or coaxially connected. A rigid and/or coaxial connection enables a particularly simple construction of the drive system and a particularly high braking effect. For example, a section of the motor shaft can be press-fitted with a section of the brake shaft.

The brake shaft can be releasably connected to the motor shaft during operation of the drive device, for example by means of a one-way clutch and/or a, in particular electrically, switchable clutch for separating the brake shaft from the motor shaft, while the threaded spindle is driven by the motor assembly. As a result, the drive system can work more energy-efficiently and/or the motor assembly can be designed to be less powerful and thus smaller, lighter and/or less expensive. A connection of the motor shaft to the brake shaft that can be released during operation of the drive device can be designed, for example, as a brake arrangement as described in the document DE 10 2014 212 863 A1. The corresponding paragraphs [0006] to [0013] and [0028] to [0044] of DE 10 2014 212 863 A1 are incorporated here by reference.

The brake assembly can comprise a hysteresis brake, in particular with at least one rotor rigidly connected, glued and/or press-fitted, to the brake shaft and at least one stator fixedly arranged at a housing of the brake assembly, the rotor comprising at least one permanent magnet for magnetizing the stator. Alternatively, the stator can comprise at least one permanent magnet for magnetizing the rotor. If the rotor is glued to the brake shaft, the hysteresis brake is particularly easy to manufacture. If the rotor is press-fitted to the brake shaft, this results in a connection that is particularly stable over the long term, in particular with respect to chemical solvents, and the hysteresis brake can be manufactured in particularly close tolerances.

A hysteresis brake has the advantages that it can work odourlessly and noiselessly and is more wear-resistant than mechanical friction brakes, especially to an extent of up to 20 million revolutions relevant to the drive system. Furthermore, a hysteresis brake requires only a small space along the drive axis. In addition, the braking torque of a hysteresis brake, in comparison to a mechanical friction brake, in particular in a speed range of 0 to 3000 revolutions per minute relevant for the drive system, depends less on a speed of the brake shaft and, in particular in a temperature range relevant for the drive system from −30° C. to +80° C., less on an ambient temperature of the hysteresis brake. Furthermore, the braking torque of a hysteresis brake can be predicted better than in the case of a mechanical friction brake, as a result of which a small relative tolerance of the braking torque can be achieved. With a hysteresis brake, the braking torque can therefore be designed much more precisely and with lower safety margins for the respective field of application of the drive system than with mechanical friction brakes. This enables the drive system to work particularly efficiently and reliably.

The hysteresis brake can, for example, be configured as described in the document EP 2 192 675 A1, the corresponding paragraphs [0006] to [0021] and [0024] to [0048] of which are incorporated here by reference.

The rotor and/or the stator can be arranged essentially cylindrical and/or coaxial to the brake shaft. The rotor and/or the stator can comprise a number of recesses for a connection with the brake shaft or a housing of the brake assembly that is positive with respect to a rotation about the drive axis.

The hysteresis brake, particularly if the rotor and the stator are cylindrical, can be constructed in a particularly compact manner by a coaxial arrangement. The rotor is particularly advantageously arranged in the stator, in particular the stator completely covering the rotor radially to the brake shaft. A complete overlap minimizes the strength of a magnetic field outside the stator, as a result of which undesired magnetization of further components, for example a bearing, can be reduced or even completely prevented.

The rotor is advantageously arranged centrally in the stator along the brake shaft. This minimizes magnetic forces that act on the rotor along the brake shaft and could thereby loosen the connection of the rotor to the brake shaft.

If the rotor is arranged within the stator, it is particularly advantageous if the rotor comprises at least one permanent magnet for magnetizing the stator. When operating the hysteresis brake, heat is mainly generated in the component whose magnetization is changed. If this component is the external stator, this heat can be dissipated more easily than if this component is the internal rotor.

The rotor and the stator can be spaced apart from one another, for example by an air gap. This advantageously prevents the rotor and the stator from rubbing against one another during operation of the hysteresis brake, which would result in increased noise and heat development and increased wear. Furthermore, by selecting a gap dimension between the rotor and the stator, the strength of the magnetic interaction therebetween can be set and thus a braking torque of the hysteresis brake suitable for the drive system can be set. For typical applications of the drive system, a gap dimension of 0.1 mm to 1 mm, in particular of 0.2 mm to 0.8 mm, for example 0.5 mm, has proven to be particularly advantageous for generating a high braking torque that can be achieved with manufacturing tolerances of conventional manufacturing methods.

The strength of the magnetic interaction between the rotor and the stator, and thus the braking torque, can be adjusted by choosing a length of the rotor and/or the stator along the brake shaft. For the simplest possible production of hysteresis brakes with different braking torques, it is particularly advantageous if the braking torque is set by the choice of the length of the rotor arranged within the stator. As a result, different braking torques can be achieved by varying a single component, namely the rotor, without changing the space required by the hysteresis brake, which is essentially determined by the stator. For typical applications of the drive system, a length of the stator of one of 5 mm to 50 mm, of 10 mm to 20 mm, or 13 mm, has proven to be particularly advantageous, the length of the rotor being less than or equal to the length of the stator, for example 12.5 mm with a length of the stator of 13 mm.

The rotor can be arranged in the stator and have a rotor length along the brake shaft and a rotor outer diameter orthogonal to the brake shaft, and the stator can have a stator length along the brake shaft and have a stator inner diameter orthogonal to the brake shaft, wherein the dimensions mentioned are in the following relationship to one another and have the following values:

a. Rotor length from 5 mm to 50 mm, in particular from 10 mm to 20 mm, for example 12.5 mm;
b. Rotor outer diameter from 5 mm to 50 mm, in particular from 10 mm to 20 mm, for example 13.5mm;
c. Stator length from 5 mm to 50 mm, in particular from 10 mm to 20 mm, for example 13 mm; and
d. Stator inner diameter from 5 mm to 50 mm, in particular from 10 mm to 20 mm, for example 14.5 mm.

The rotor length is chosen to be less than or equal to the stator length, and/or the rotor outer diameter and the stator inner diameter are selected such that the gap dimension is from 0.1 mm to 1 mm, in particular from 0.2 mm to 0.8 mm, for example 0.5 mm.

Due to the abovementioned ratios or dimensions, a braking torque suitable for conventional applications of the drive system is achieved with conventional stator and rotor materials, and the drive system can be manufactured inexpensively using conventional manufacturing methods and manufacturing tolerances. Of course, the dimensions can be scaled according to the application requirements, whereby in particular the gap dimension can remain constant.

A spacer, made of a polymer, can be arranged between the rotor and the brake shaft. The spacer can reduce unwanted magnetization of the brake shaft. Furthermore, the spacer can also ensure that other components that are not to be magnetized, for example a bearing, are spaced apart.

The rotor can be attached directly to the brake shaft, for example glued on. The brake assembly can be manufactured particularly inexpensively, in particular more cost-effectively than when a spacer is used, by direct fastening. If the brake shaft is made of a magnetizable material, for example steel, there is the additional advantage, when the rotor is directly attached to it, that magnetizing the brake shaft can increase the magnetic interaction with the stator and thus the braking torque.

The rotor can be secured against displacement along the brake shaft by a locking element, for example a locking ring on the brake shaft.

The brake assembly may include a heat sink for receiving heat generated when the rotor or stator is magnetized. The heat sink can advantageously prevent heat-sensitive parts of the drive system from overheating. The heat sink can comprise, for example, a metal block, in particular thermally conductively connected with the stator, in particular with heat radiation fins.

The rotor and/or the stator can consist of a number of modules arranged one behind the other along the brake shaft. As a result, the magnetic interaction between the rotor and the stator and thus the braking torque of the brake assembly can advantageously be set for different applications of the drive system via the number of modules used.

The brake assembly can comprise a coil for strengthening and/or weakening a magnetic field of the permanent magnet. The magnetic interaction between the rotor and the stator and thus the braking torque of the brake assembly can advantageously be set, in particular during operation of the drive system, via an electrical current flowing through the coil. For example, the braking torque can be reduced while a motor drives the threaded spindle to make the drive system work more efficiently.

The permanent magnet can consist of a rare earth alloy, for example a neodymium-iron-boron alloy, and the rotor or the stator can consist of an aluminium-nickel-cobalt alloy. A neodymium-iron-boron alloy is particularly suitable for producing a permanent magnet with a high magnetization, while an aluminium-nickel-cobalt alloy can be magnetized particularly well by a permanent magnet due to its low coercive field strength. The permanent magnet can advantageously have at least one anti-corrosion coating, for example a nickel, nickel-copper and/or plastic coating, in particular an epoxy resin coating. A plastic coating has the additional advantage, particularly if the permanent magnet consists of a generally brittle rare earth alloy, that it can also protect the permanent magnet from mechanical loads.

The at least one motor assembly can be spaced apart from the at least one brake assembly. This ensures that the function of these two assemblies does not interfere with one another, for example by the transfer of heat and/or vibrations. In particular, it could otherwise happen that a permanent magnet of the brake assembly is heated above its Curie temperature by heat emitted by the motor assembly and thereby loses its magnetization, which would impair the braking effect of the brake assembly. This danger exists in particular with neodymium-iron-boron magnets which have a relatively low Curie temperature in the range of 80° C.

For example, the at least one transmission assembly and/or a thermal insulating means or thermal insulator can be arranged between the motor assembly and the brake assembly, and/or the motor assembly and the brake assembly can be arranged on opposite sides of the spindle axis.

The drive system can comprise at least one clutch assembly for decoupling a rotary movement of the threaded spindle about the spindle axis from a rotary movement of the drive shaft about the drive axis. The clutch assembly can include an overload clutch, in particular for protecting a door actuated by the drive system and/or a connection device of the drive system to the door, for example a ball pin, against overload.

The drive system can be designed particularly advantageously such that the overload clutch is triggered under a load that is less than a maximum load that can be absorbed by the door, the connecting element and the drive system in each case without damage. Furthermore, the drive system is advantageously designed in such a way that its maximum load is less than the respective maximum load on the door and the connecting element. This ensures that in the event of a malfunction or incorrect operation, it is not the door or the connecting element that is damaged, but only the drive system, which is usually easier to replace.

The spindle assembly can comprise a guide bush for guidance and/or a spindle bearing for supporting the threaded spindle. The guide bushing and/or the spindle bearing can prevent undesired translational movements of the threaded spindle, which could impair the function of a coupling and/or a gear connected to the threaded spindle, for example, so that the drive system operates reliably.

The following comprises the use of a drive system according to embodiments of the invention for actuating a door, in particular a vehicle door. According to embodiments of the invention, the drive system can also be used to move other objects, for example to adjust the height of a table.

A production method according to embodiments of the invention for a drive system, in particular according to embodiments of the invention, in particular for actuating a door, for example a vehicle door, comprises at least the following steps:

a. applying an adhesive to a brake shaft and/or a rotor for a hysteresis brake for the drive system;

b. attaching the rotor directly to the brake shaft and c. cohesive connecting of the rotor to the brake shaft by the adhesive.

By attaching the rotor directly to the brake shaft, a particularly compact structure of the hysteresis brake and thus of the drive system is achieved. The cohesive connection ensures a stable and permanent attachment of the rotor to the brake shaft. The adhesive can in particular be selected such that a permanently elastic connection is created between the rotor and the brake shaft, so that possible vibrations of the brake shaft, which could damage the rotor, are transmitted to the latter in a damped manner.

Alternatively, a production method for a drive system, in particular according to embodiments of the invention, can comprise the following steps:

a. applying a spacer to a brake shaft for a hysteresis brake for the drive system;

b. attaching a rotor to the spacer and c. press-fitting the spacer to the brake shaft and the rotor.

A particularly reliable and long-term stable connection of the spacer to the brake shaft and the rotor can be achieved by press-fitting. In particular, no adhesive is necessary that is difficult to control in terms of process technology, for example because its viscosity and/or its drying behaviour depend on environmental parameters such as temperature and humidity. In addition, an adhesive can at least partially lose its adhesion-promoting effect through aging processes, thereby endangering the long-term stability of an adhesive connection.

If the rotor comprises a permanent magnet, in particular a rare earth magnet, for example made of a neodymium-iron-boron alloy, the rotor is generally too brittle to be press-fitted directly onto the brake shaft. This problem is solved according to embodiments of the invention in that a spacer, in particular made of a polymer, is applied between the brake shaft and the rotor. The spacer can at least partially absorb forces occurring during the press-fitting, for example by plastic deformation, so that the rotor is not exposed to any stresses which could damage the rotor.

For a particularly simple construction of the drive system and a particularly reliable connection of the rotor to the brake shaft, the spacer can, for example, be applied cylindrically around the brake shaft, in particular in contact therewith, and/or the rotor can be mounted cylindrically around the spacer, in particular in contact with it.

The press-fitting can, for example, comprise a radial expansion of the brake shaft, as a result of which a force directed radially outward from the brake shaft acts on the spacer and the rotor in order to press-fit them to one another and to the brake shaft. The press-fitting can include, for example, applying an axial force to the spacer, which can be designed, for example, as a bushing applied on the brake shaft, as a result of which the spacer is press-fitted into a space between the brake shaft and the rotor.

The production method can include applying a securing element, in particular a securing ring, to the brake shaft to secure the rotor against displacement along the brake shaft.

Further advantages, goals and properties of embodiments of the present invention are explained on the basis of the following description and attached drawings, in which drive systems according to embodiments of the invention are shown by way of example. Components of the drive systems in the figures, which correspond at least essentially in terms of their function can be identified with the same reference numbers, these components need not be numbered and explained in all the figures.

BRIEF DESCRIPTION

Some of the embodiments will be described in detail, with reference to the following figures, wherein like designations denote like members, wherein:

FIG. 1*a* is a schematic drawing of a drive system according to embodiments of the invention;

FIG. 1*b* is a schematic drawing of a drive system according to embodiments of the invention;

Figure 8A:
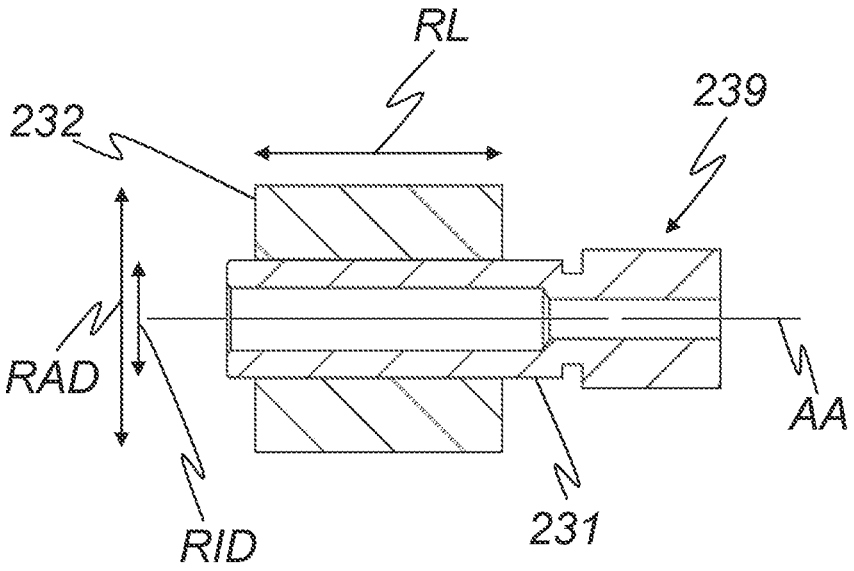
Figure 8B:
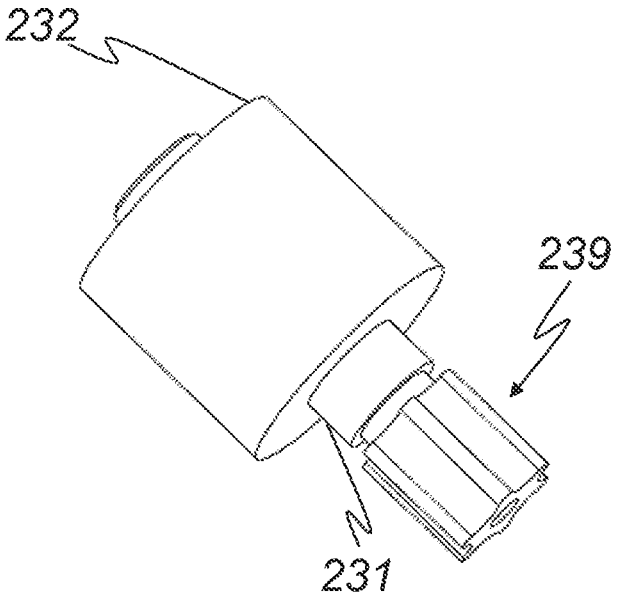
Figure 9A:
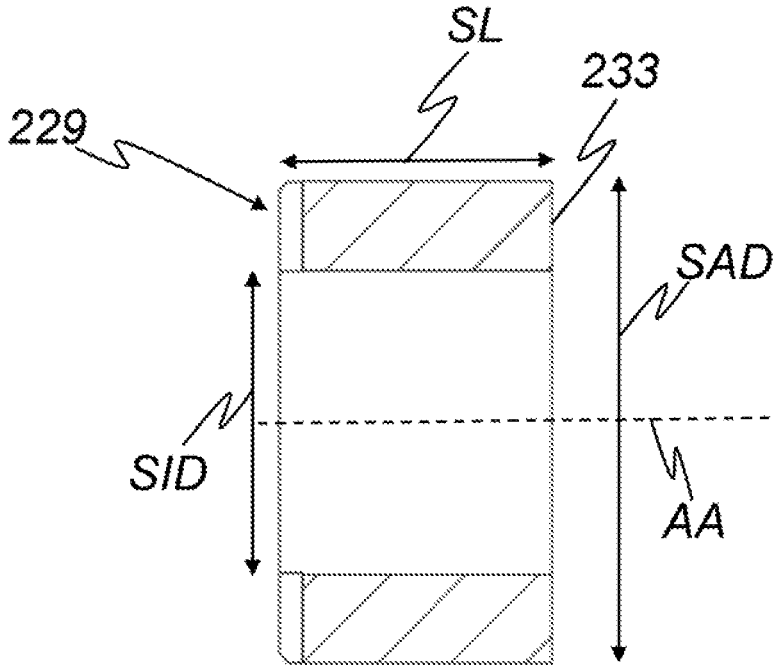
Figure 9B:
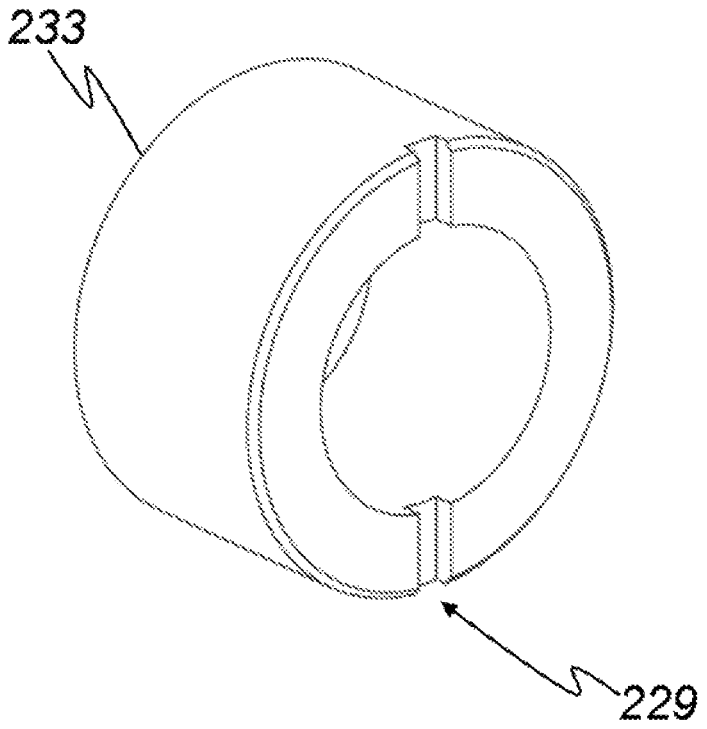
Figure 10:
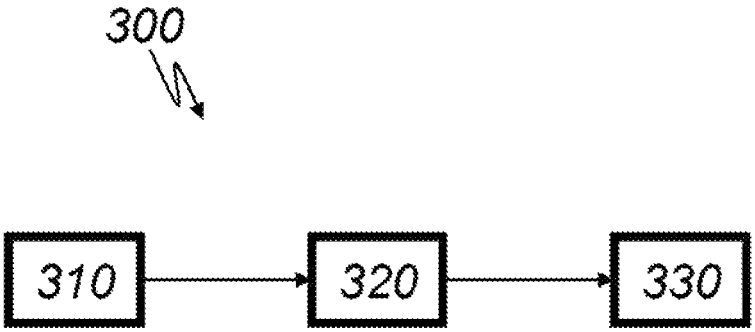

FIG. 8*a* is a schematic representation of a rotor according to embodiments of the invention on a brake shaft;

FIG. 8*b* is a schematic representation of a rotor according to embodiments of the invention on a brake shaft;

FIG. 9*a* is a schematic representation of a stator according to embodiments of the invention;

FIG. 9*b* is a schematic representation of a stator according to embodiments of the invention; and FIG. 10 is a schematic representation of a method according to embodiments of the invention.

DETAILED DESCRIPTION

Figure 1A:
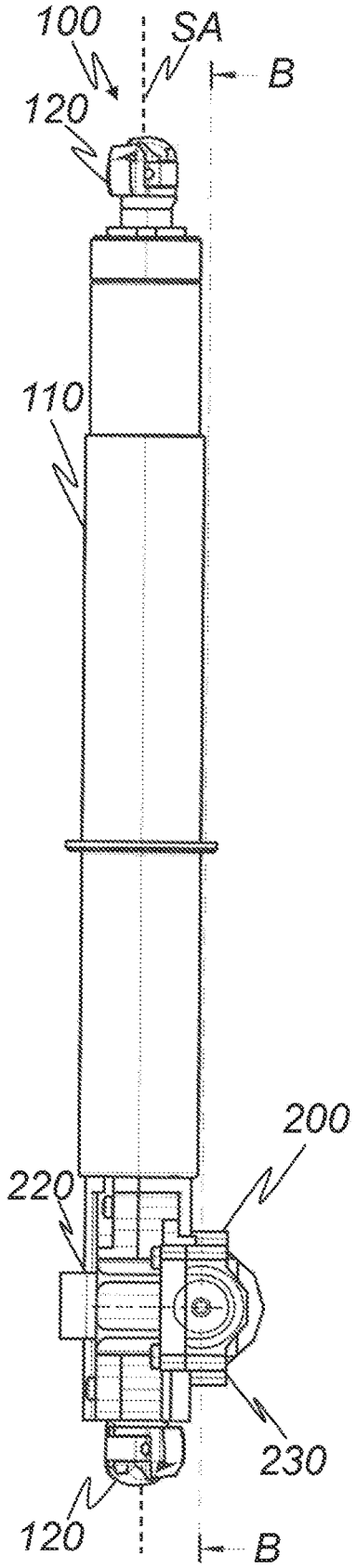
Figure 1B:
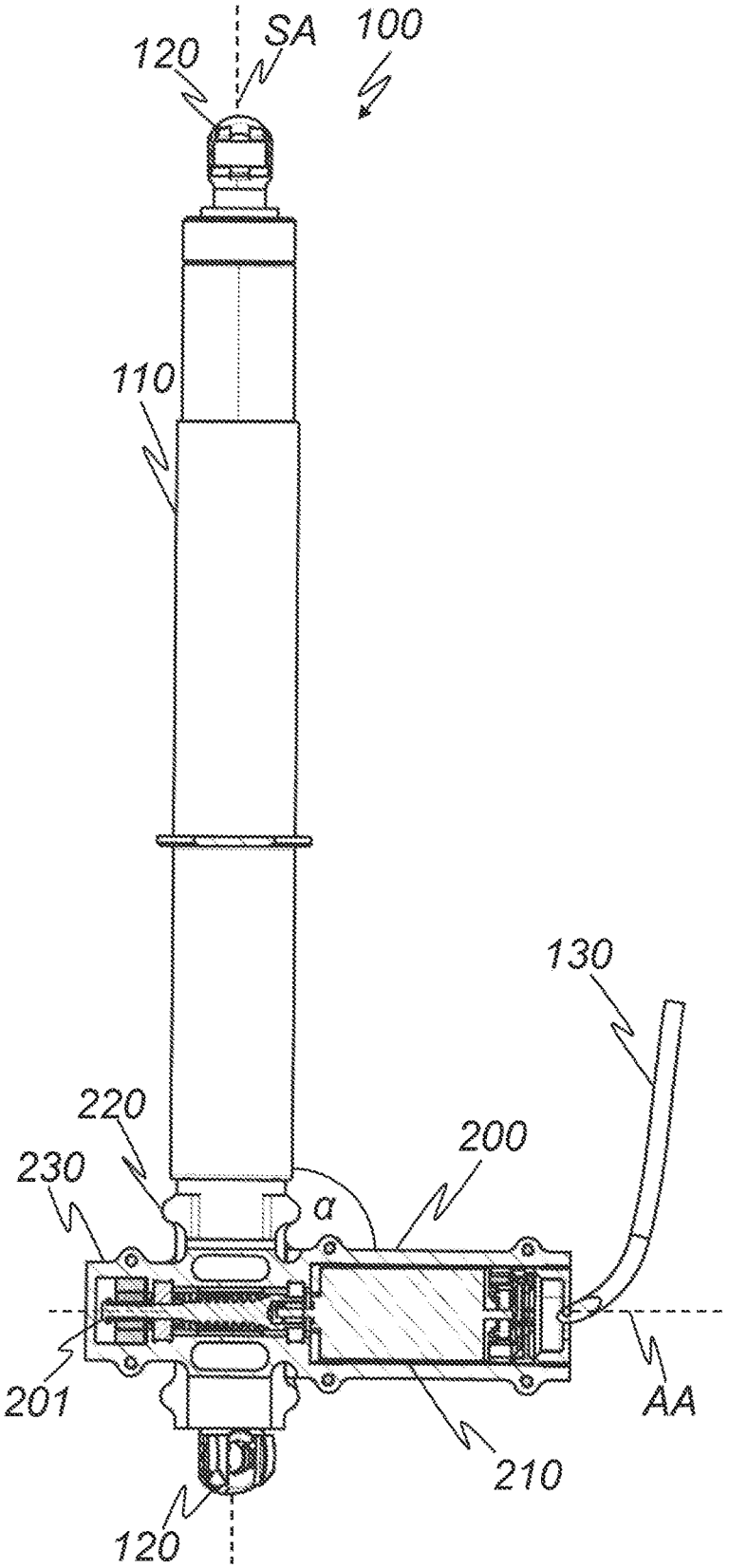

FIG. 1 shows a schematic drawing of a drive system 100 according to embodiments of the invention as a side view (FIG. 1*a*) and as a section (FIG. 1*b*) in the plane B-B marked in FIG. 1*a*. The drive system 100 shown comprises a spindle assembly 110 and a drive assembly 200, which are connected to one another by a gear assembly 220. The spindle assembly 110 comprises a threaded spindle (not shown) rotatable about a spindle axis SA and the drive assembly 200 comprises a drive shaft 201 rotatable about a drive axis AA. The threaded spindle and the drive shaft 201 are mechanically coupled to one another, for example, via the gear assembly 200, the gear assembly 220 being designed to translate a rotational movement about the drive axis AA into a rotational movement about the spindle axis SA.

The drive assembly 200 shown comprises a motor assembly 210 for driving a rotary movement of the threaded spindle about the spindle axis SA and a brake assembly 230 arranged on a side of the motor assembly 210 facing the gear assembly 220 for braking a rotary movement of the threaded spindle about the spindle axis SA. The transmission assembly 220 is arranged, for example, between the motor assembly 210 and the brake assembly 230

In the example shown, the drive axis AA and the spindle axis SA are not arranged coaxially and form an angle $\alpha$, which is, for example, 90°. A supply line 130, in particular for supplying the drive system 100 with energy and/or control signals, is arranged, for example, at the drive assembly 200. A connection device 120 is arranged, for example, at the ends of the drive system 100 along the spindle axis SA. The connection devices 120, which can each comprise a ball stud, for example, can be designed, for example, to connect the drive system 100 to a vehicle (not shown) and a vehicle door (not shown) of the vehicle, for actuation of which the drive system 100 is provided.

Figure 2:
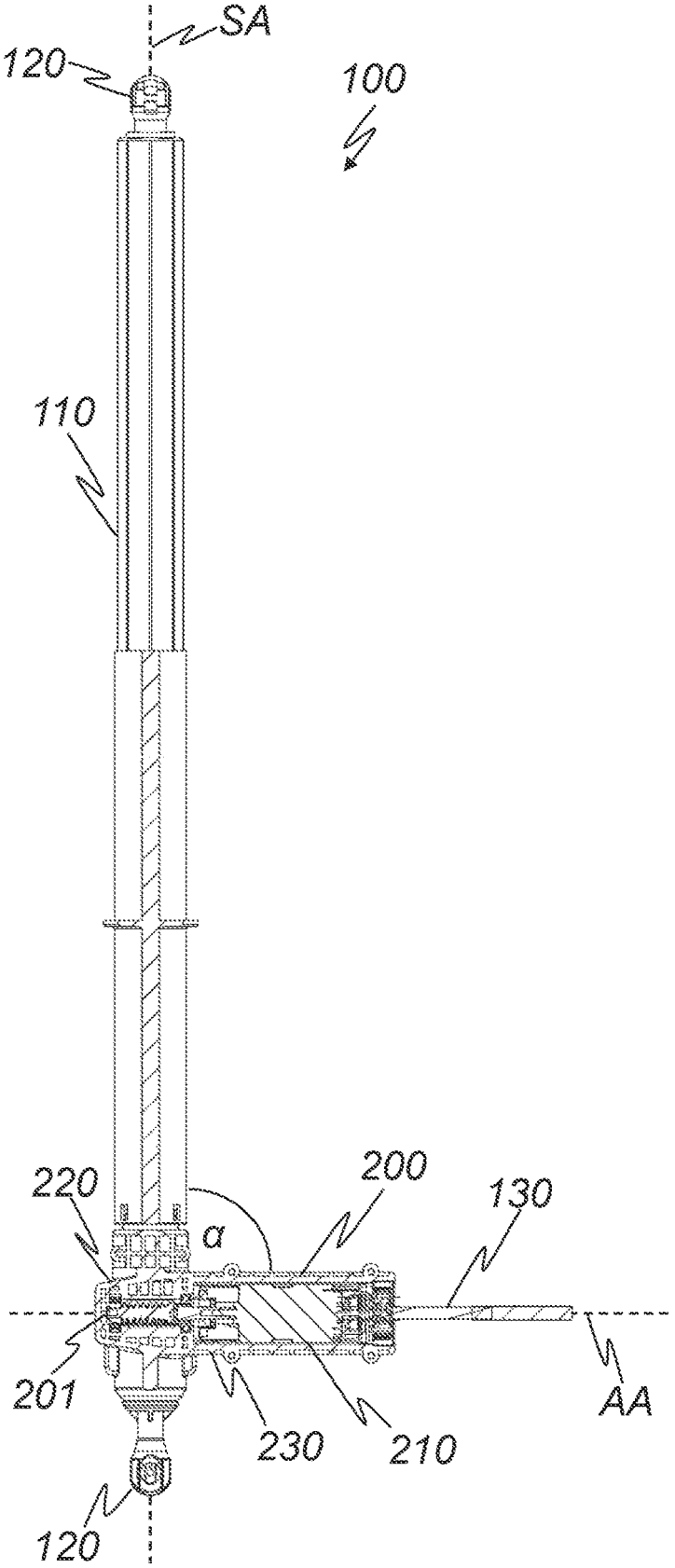
FIG. 2 shows a schematic drawing of a further drive system according to embodiments of the invention.

FIG. 2 shows a further drive system 100 according to embodiments of the invention as a section as in FIG. 1*b*. In contrast to the drive system 100 shown in FIG. 1, in the drive system 100 shown in FIG. 2, the brake assembly 230 is arranged between the motor assembly 210 and the transmission assembly 220.

Figure 3:
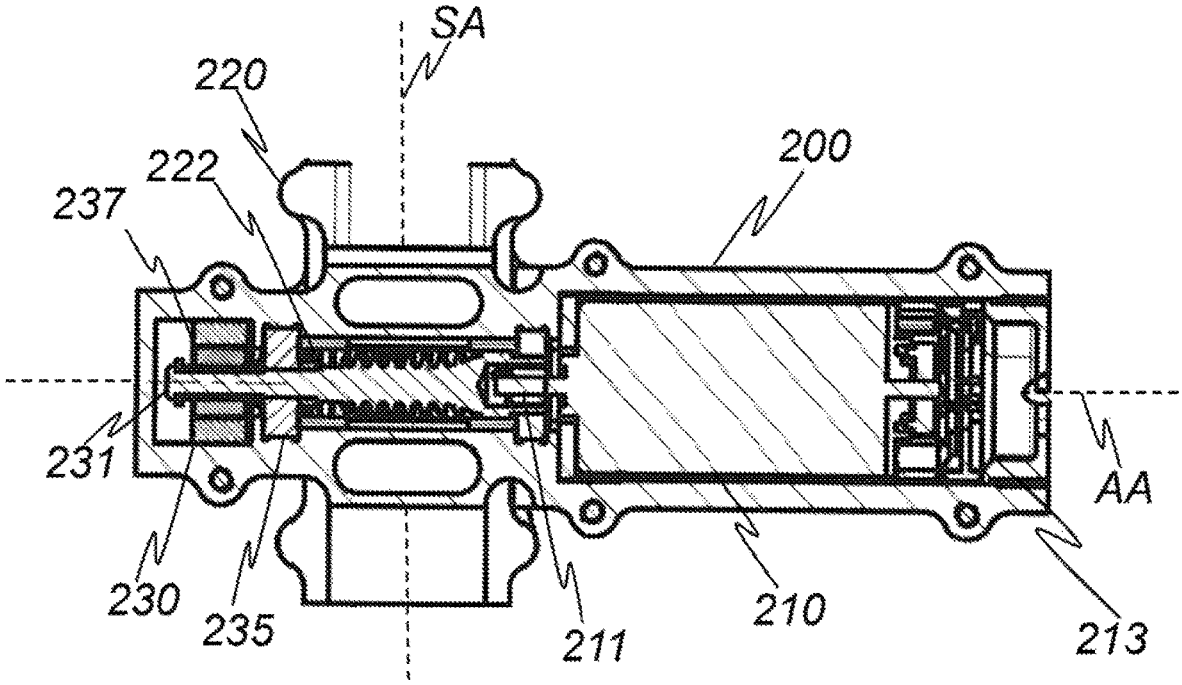
FIG. 3 shows a schematic sectional drawing of a drive assembly according to embodiments of the invention.

FIG. 3 shows a schematic sectional drawing of a drive assembly 200 according to embodiments of the invention. The illustrated drive assembly 200 comprises a motor assembly 210 for driving a rotary movement of a threaded spindle (not shown) about a spindle axis SA with a motor shaft 211 rotatable about a drive axis AA.

The drive assembly 200 shown comprises a brake assembly 230 for braking a rotary movement of the threaded spindle about the spindle axis SA with a brake shaft 231, which can be rotated about the drive axis AA and is guided, for example, by a bearing 235. The brake assembly 230 includes a hysteresis brake 237, for example. The brake shaft 231 is, in particular rigidly, connected to the motor shaft 211, for example via a worm shaft 222 of a transmission assembly 220, the brake shaft 231, worm shaft 222 and motor shaft 211 advantageously being arranged coaxially to one another and/or forming together a drive shaft 201 of the drive assembly 200.

In the example shown, the motor assembly 210 and the brake assembly 230 are arranged on opposite sides of the spindle axis SA and the transmission assembly 220.

The illustrated motor assembly 210 includes an angular position sensor 213, in particular a Hall sensor, for measuring an angular position of the motor shaft 211 relative to the motor assembly 210, the angular position sensor 213 being arranged, for example, on a side of the motor assembly 210 facing away from the brake assembly 230.

Figure 4:
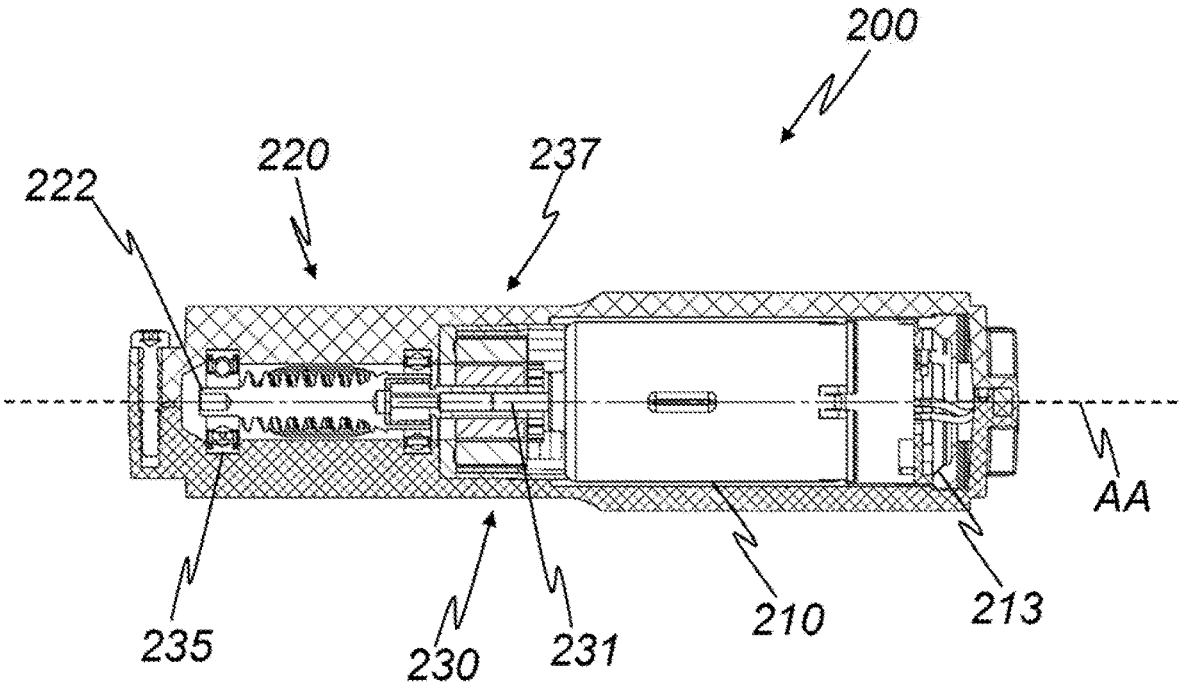
FIG. 4 shows a schematic sectional drawing of a further drive assembly according to embodiments of the invention.

FIG. 4 shows a schematic sectional drawing of a further drive assembly 200 according embodiments of to the invention. The illustrated drive assembly 200 differs from the drive assembly 200 shown in FIG. 3 in that the brake assembly 230 is arranged between the motor assembly 210 and the transmission assembly 220.

Figure 5:
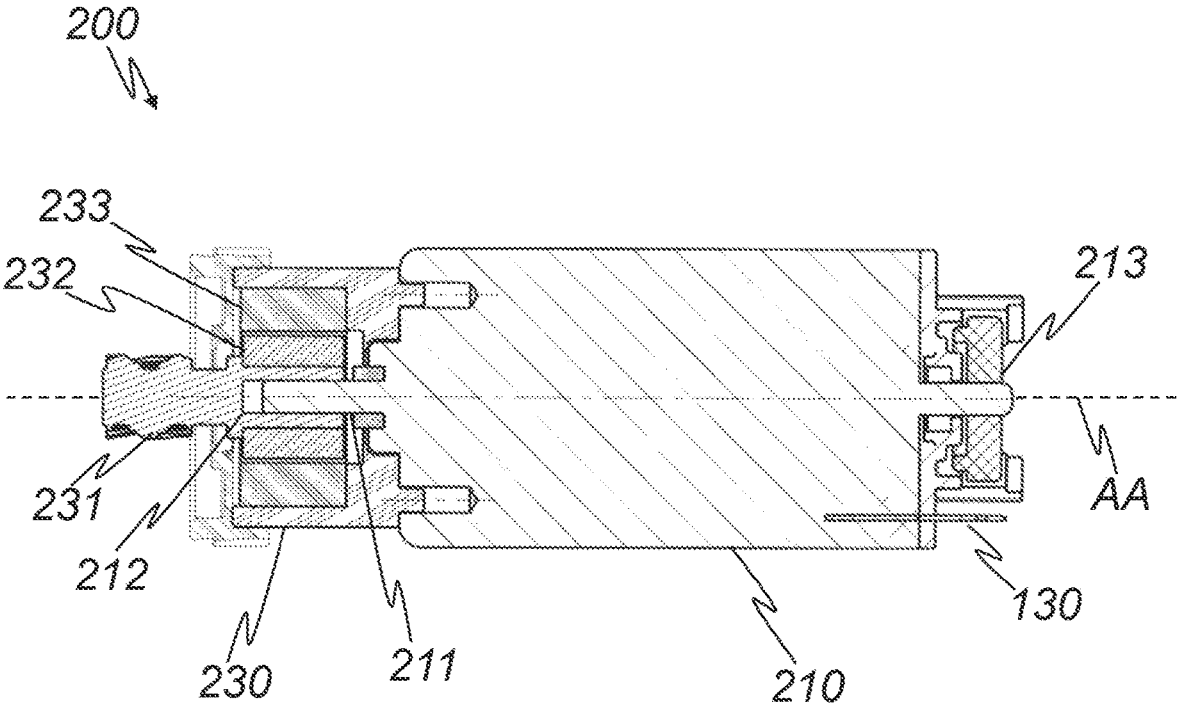
FIG. 5 shows a schematic sectional drawing of a further drive assembly according to embodiments of the invention.

FIG. 5 shows a schematic sectional drawing of a further drive assembly 200 according to embodiments of the invention. The drive assembly 200 shown comprises, like the drive assembly 200 shown in FIG. 4, a motor assembly 210 with a motor shaft 211 rotatable about a drive axis AA and an angular position sensor 213. A supply line 130 for supplying the motor assembly 210 with energy and/or control signals is also shown.

In the example shown, the motor shaft 211 is directly and rigidly connected to a brake shaft 231 of a brake assembly 230, which can be rotated about the drive axis AA, on the side of the motor assembly 210 facing away from the angular position sensor 213, for example by the motor shaft 211 being inserted coaxially in a recess 212 in the brake shaft 231 and press-fitted to it.

A, in particular cylindrical, rotor 232 is attached to the illustrated brake shaft 231, for example coaxially to the brake shaft 231. The rotor 232 shown, which comprises, for example, a permanent magnet, is arranged, in particular coaxially, in a, for example cylindrical, stator 233, which can be magnetized by the rotor 232. The rotor 232 and the stator 233 form a hysteresis brake together.

Figure 6:
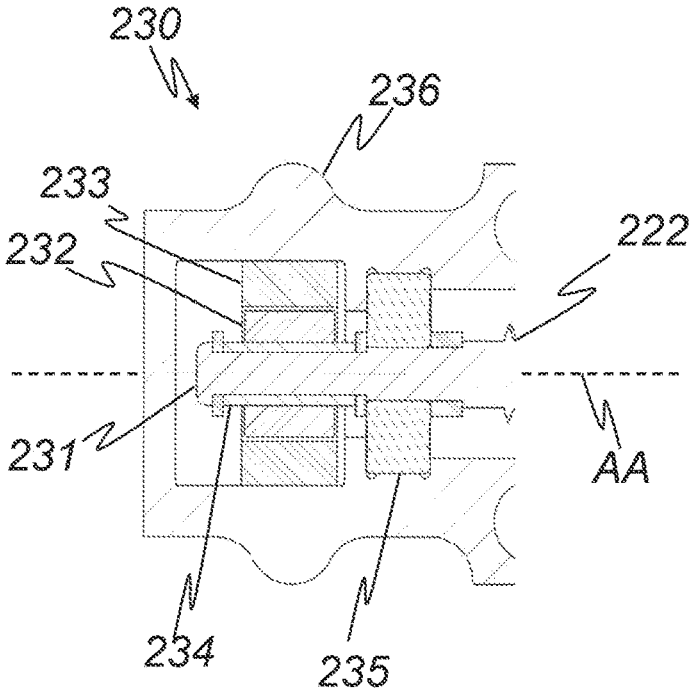
FIG. 6 shows a schematic sectional drawing of a brake assembly according to embodiments of the invention.

FIG. 6 shows a schematic sectional drawing of a brake assembly 230 according to embodiments of the invention. The brake assembly 230 shown comprises a brake shaft 231 which is rotatable about a drive axis AA and is guided by a bearing 235. The brake shaft 231 shown is rigidly connected to a worm shaft 222 of a gear assembly (not shown), for example it is formed integrally therewith. The illustrated brake assembly 230 comprises a rotor 232 and a stator 233, which form a hysteresis brake together and can be arranged and configured as shown in FIG. 3, with the difference that in FIG. 4 the rotor 232 is spaced apart from the brake shaft 231 by a spacer 234. The spacer 234, for example made of a polymer, is shaped in the example shown in such a way that the spacer 234 spaces the rotor 232 apart from the brake shaft 231 and the bearing 235. The brake assembly 230 shown is enclosed by a housing 236, which is composed, for example, of two plastic half-shells.

Figure 7:
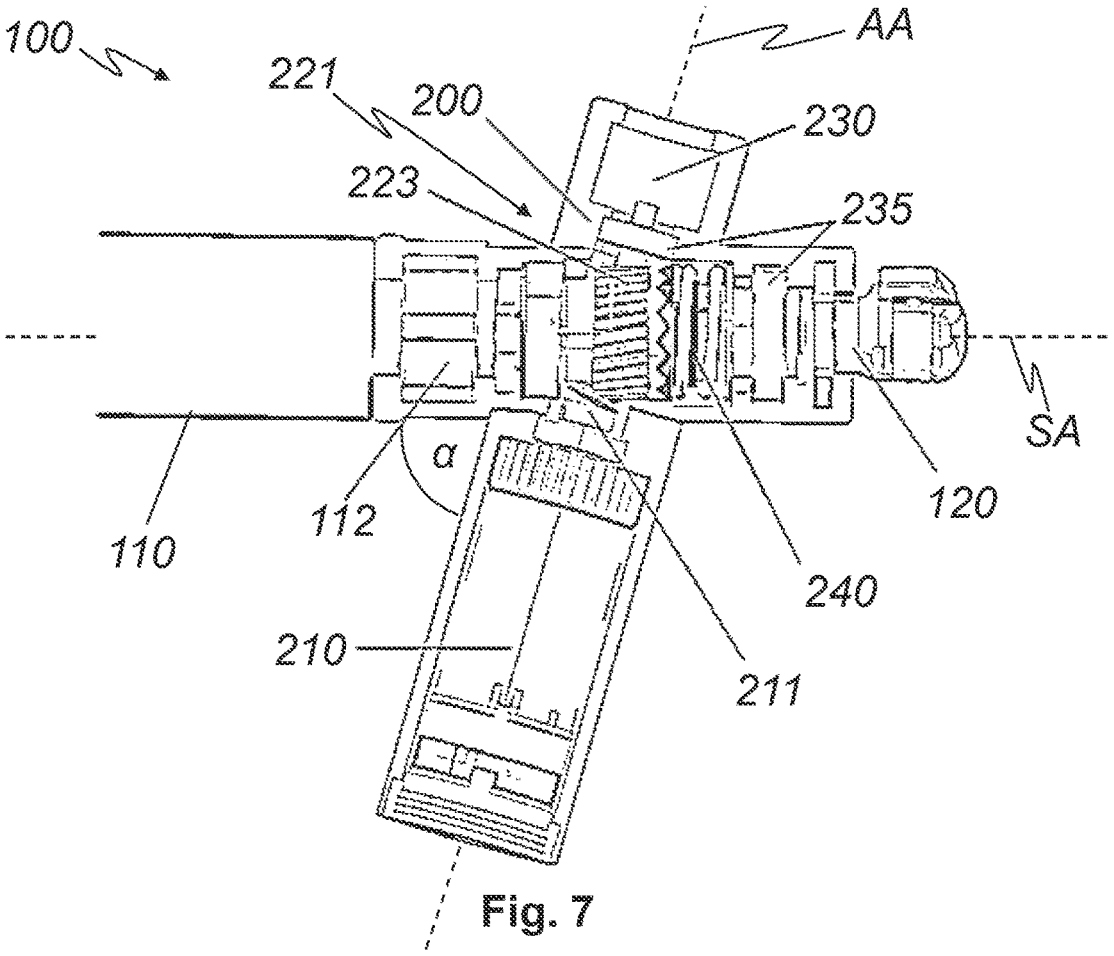
FIG. 7 shows a schematic sectional drawing of a further drive system according to embodiments of the invention.

FIG. 7 shows a schematic sectional drawing of a further drive system 100 according to embodiments of the invention. Components that are already shown in FIG. 1 are provided with the same reference numerals as there and are not described again. The spindle assembly 110 shown comprises a guide bushing 112 for guiding a threaded spindle (not shown). In the example shown, the threaded spindle, which can be rotated about a spindle axis SA, is mechanically coupled to a worm wheel 223 of a worm gear 221 via a clutch assembly 240, for example with an overload clutch. The worm wheel 223 shown is mechanically coupled to a worm shaft (not shown) of the worm gear 221, the worm shaft being rotatable about a drive axis AA and, in particular rigidly and/or coaxially, connected to a motor shaft 211 of a motor assembly 210. Both the threaded spindle and the worm shaft can each be mounted on at least one bearing 235. In the example shown, the angle $\alpha$ enclosed by the spindle axis SA and the drive axis AA is approximately 75°.

FIG. 8 shows a schematic illustration of a rotor 232 according to embodiments of the invention on a brake shaft 231 as a section along the drive axis AA (FIG. 8*a*) and as a perspective illustration (FIG. 8*b*). The rotor 232 is glued directly to the brake shaft 231, for example. The rotor 232 shown is cylindrical and has, for example, a rotor length RL of 12.5 mm, an inner rotor diameter RID of 5.95 mm and/or an outer rotor diameter RAD of 13.5 mm. The rotor 232 can for example consist of a neodymium-iron-boron alloy, in particular with a nickel-copper coating.

The brake shaft 231 has, for example, a section 239 for the connection with a worm shaft of a gear assembly (not shown) with a positive connection with respect to a rotation about the drive axis AA. Section 239 is designed, for example, as a gearwheel.

The brake shaft 231 can be hollow, at least in sections, so that a motor shaft of a motor assembly (not shown) and/or a worm shaft of a transmission assembly (not shown) can be at least partially inserted into the brake shaft 231 and press-fitted to it, for example.

FIG. 9 shows a schematic illustration of a stator 233 according to embodiments of the invention as a section along the drive axis AA (FIG. 9*a*) and as a perspective illustration (FIG. 9*b*). The stator 233 shown is essentially cylindrical and has, for example, a stator length SL of 13 mm, a stator inner diameter SID of 14.5 mm and/or an outer stator diameter of 23 mm. The stator 233 can consist, for example, of an aluminium-nickel-copper alloy.

The stator 233 shown has a number of, for example two, recesses 229 for connecting the stator 233 with a housing of a brake assembly (not shown) in a form-locking manner with respect to a rotation about the drive axis AA.

FIG. 10 shows a schematic illustration of a production method 300 according to embodiments of the invention for a drive system 100. The production method 300 initially comprises applying 310 an adhesive to a brake shaft 231 and/or a rotor 232 for a hysteresis brake 237 for the drive system 100. For example, the next step is attaching 320 the rotor 232 directly to the brake shaft 231, for example by pushing the rotor 232 coaxially onto the brake shaft 231. For example, in the following step, there is a cohesive connecting 330 of the rotor 232 to the brake shaft 231 by means of the adhesive. The further manufacture of the hysteresis brake and the drive system can take place, for example, using customary manufacturing methods.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

REFERENCE SIGN LIST

100 Drive system
110 Spindle assembly
112 Guide bushing
120 Connection device
130 Supply line
200 Drive assembly
201 Drive shaft

210 Motor assembly
211 Motor shaft
212 Recess
231 Angular position sensor
220 Gear assembly
221 Worm gear
222 Worm shaft
223 Worm wheel
229 Recess
230 Brake assembly
231 Brake shaft
232 Rotor
233 Stator
234 Spacer
235 Bearing
236 Housing
237 Hysteresis brake
239 Section
240 Clutch assembly
300 Production method
310 Applying
320 Attaching
330 Connecting
RAD rotor outer diameter
RID rotor inner diameter
RL rotor length
SAD stator outer diameter
SID stator inner diameter
SL stator length
AA drive axis
SA spindle axis
α angle

The invention claimed is:

1. A motorized drive system, for actuating a door, comprising:

a. at least one gear module with a spindle axis and a drive axis, the gear module being designed to translate a rotational movement about the drive axis into a rotational movement about the spindle axis;

b. at least one spindle assembly with a threaded spindle rotatable about a spindle axis, the threaded spindle being mechanically coupled to a part of the gear assembly rotatable about the spindle axis;

c. at least one drive assembly for driving the threaded spindle with a drive shaft, the drive shaft being mechanically coupled to a part of the transmission assembly rotatable about the drive axis, wherein the at least a drive assembly comprises:

d. at least one motor assembly for driving a rotary movement of the threaded spindle about the spindle axis with a motor shaft rotatable about the drive axis and rigidly connected to the drive shaft and;

e. at least one brake assembly arranged on a side of the motor assembly facing the transmission assembly for braking a rotary movement of the threaded spindle about the spindle axis with a brake shaft that is rotatable about the drive axis and connected rigidly with the motor shaft, the brake assembly comprising a hysteresis brake, f. wherein the motor assembly comprises an angular position sensor for measuring an angular position of the motor shaft relative to the motor assembly, wherein the angular position sensor is arranged on a side of the motor assembly facing away from the brake assembly, g. wherein the hysteresis brake comprises at least one rotor rigidly connected to the brake shaft and at least one stator arranged stationary at a housing of the brake assembly, the rotor comprising at least one permanent magnet for magnetizing the stator, or the stator comprising at least one permanent magnet for magnetizing the rotor.

2. The drive system according to claim 1, wherein the spindle axis and the drive axis are not arranged coaxially, and the drive assembly is arranged to the side of the spindle axis, wherein the spindle axis and the drive axis form an angle that amounts from one of 45° to 90°, from 60° to 90°, or 90°.

3. The drive system according to claim 1, wherein the angular position sensor comprises a Hall sensor.

4. The drive system according to claim 1, wherein the at least one gear assembly comprises a worm gear for translating a rotational movement about the drive axis into a rotational movement about the spindle axis, the worm gear comprising:

a. a worm shaft rotatable about the drive axis) and mechanically coupled to the drive shaft; and b. a worm wheel rotatable about the spindle axis and mechanically coupled to the threaded spindle, the worm shaft being comprised by the drive shaft or rigidly or coaxially connected with a motor shaft of a motor assembly.

5. The drive system according to claim 1, wherein the rotor and the stator are arranged substantially cylindrically and coaxially to the brake shaft, the rotor being arranged in the stator and having a rotor length along the brake shaft and an outer rotor diameter orthogonal to the brake shaft, and the stator having a stator length along the brake shaft and an inner stator diameter orthogonal to the brake shaft, where the dimensions mentioned are in the following relationship to one another and have the following values:

a. rotor length from one of 5 mm to 50 mm, 10 mm to 20 mm, or 12.5 mm;

b. rotor outer diameter from one of 5 mm to 50 mm, from 10 mm to 20 mm, or 13.5 mm;

c. stator length from one of 5 mm to 50 mm, from 10 mm to 20 mm, or 13 mm; and d. stator inner diameter from one of 5 mm to 50 mm, from 10 mm to 20 mm, or 14.5 mm.

6. The drive system according to claim 1, wherein the permanent magnet is made of a neodymium-iron-boron alloy and the rotor or the stator is made of an aluminum-nickel-cobalt alloy.

7. The drive system according to claim 1, comprising at least one clutch assembly for decoupling a rotational movement of the threaded spindle about the spindle axis from a rotational movement of a drive shaft about the drive axis, wherein the clutch assembly includes an overload clutch, for protecting a door actuated by the drive system or a connecting device of the drive system to the door against overload.

8. Use of a drive system according to claim 1 for actuating a door.

9. A production method for of a drive system, according to claim 1, comprising the following steps:

a. applying an adhesive to a brake shaft or a rotor for a hysteresis brake for the drive system;

b. attaching the rotor directly to the brake shaft; and c. cohesive connecting of the rotor to the brake shaft by the adhesive.

* * * * *